US006541718B2

(12) United States Patent
Burkholder et al.

(10) Patent No.: US 6,541,718 B2
(45) Date of Patent: Apr. 1, 2003

(54) FULL POWER SWITCH ASSEMBLY FOR PORTABLE GENERATORS

(75) Inventors: Robert F. Burkholder, Jackson, TN (US); P. Brent Boyd, Jackson, TN (US); Dalton McFarland, Medina, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/834,458

(22) Filed: Apr. 13, 2001

(65) Prior Publication Data

US 2002/0125115 A1 Sep. 12, 2002

Related U.S. Application Data

(60) Provisional application No. 60/273,863, filed on Mar. 7, 2001.

(51) Int. Cl.[7] ..... H01H 9/20
(52) U.S. Cl. ..... 200/50.28; 200/50.33
(58) Field of Search ..... 200/50.28–50.33, 200/51 R, 51.17, 333, 334; 439/131, 911, 952

(56) References Cited

U.S. PATENT DOCUMENTS 3,908,103 A * 9/1975 Gyurka ..... 200/50.28
4,095,060 A * 6/1978 Keprda ..... 200/16 D
4,180,712 A * 12/1979 Lutzenberger et al. .... 200/16 D
4,240,523 A * 12/1980 Nestor et al. ..... 200/43.16 X
4,521,649 A * 6/1985 Nelson ..... 200/50.28
5,301,494 A * 4/1994 Peot et al. ..... 56/10.5
6,280,211 B1 * 8/2001 Tateishi ..... 200/50.28 X

* cited by examiner

*Primary Examiner*—J. R. Scott
(74) *Attorney, Agent, or Firm*—Suiter & Associates PC

(57) ABSTRACT

A full power switch assembly for a portable generator that is capable of instantly communicating the presence and operation of a full power switch to the user is disclosed. The full power switch assembly includes a first outlet for supplying electrical power having a first voltage (e.g., 120 VAC), a second outlet for supplying electrical power having a second voltage (e.g., 240 VAC), and a switch including a selector. The selector is movable from a first position to a second position for causing the first outlet to be capable of supplying electrical power up to a maximum power level. Movement of the selector between the first position and the second position further causes indicia to be displayed for indicating whether the first outlet is capable of supplying electrical power up to the maximum power level.

31 Claims, 5 Drawing Sheets

FULL POWER SWITCH ASSEMBLY FOR PORTABLE GENERATORS

CROSS-REFERENCE TO RELATED APPLICATIONS

The present application claims the benefit under 35 U.S.C. § 119(e) of U.S. Provisional Application Serial No. 60/273,863, filed Mar. 7, 2001. Said U.S. Provisional Application Serial No. 60/273,863 is herein incorporated by reference in its entirety.

FIELD OF THE INVENTION

The present invention generally relates to the field of portable generators, and more particularly to a full power selector switch for portable generators for allowing a user to switch off the 240 volt output of the generator so that it may provide additional 120 volt power.

BACKGROUND OF THE INVENTION

Portable generators are typically designed to be compatible with the utility supplied power systems that serve most residential buildings. Thus, the power from the generator can be safely applied during a utility outage through a transfer switch. To maintain the correct electrical supply in the United States, the output of the alternator is connected such that there are two 240 VAC power leads in addition to a neutral lead. This provides the user with the choice of using either 240 volts or 120 volts in any combination up to the limit of the generator.

Because portable generators produce a limited amount of power ( i.e., limited wattage), it is often desirable to optimize the amount of power available for a larger 120 volt load or for a load having a large surge wattage. Such loads may be encountered, for instance, when a 120 volt induction motor being powered by the generator is started and operated. Consequently, portable generators often employ a "full power switch" which allows a user to switch off the 240 volt output in order to get more 120 volt power from the generator thereby improving the generator's ability to power larger 120 volt loads and to sustain 120 volt surge loads. When full power is selected, the alternator output is reconnected so that the windings are coupled together to additively produce 120 volts while making 240 volt output unavailable.

While it is advantageous to provide users with the option of switching off the 240 volt output of the generator in order to get more power for large 120 volt loads, it has been discovered that users often do not use the feature properly, thereby diminishing the utility of the generator. For example, a user may fail to select the full power switch when a large 120 volt load is to be supplied, such as when an induction motor is started, or, conversely, may fail to deselect the full power switch when 240 volt power is required. Further, since only half of the 240 volt outlet is energized to 120 VAC, failure to disconnect a plug inserted in the outlet can cause unsafe conditions or damaged equipment.

In the past, portable generator manufacturers have attempted to explain proper use of the full power switch through labeling of the panel on which the switch is mounted. However, such labeling has been found to be inadequate to adequately compensate for user error. Consequently, it would be advantageous to provide a full power switch assembly for a portable generator that is capable of instantly communicating the presence and operation of the full power switch to the user. Further, it is desirable to provide a mechanical interlock for the full power switch that requires the user to disengage all plugs from the generator's 240 volt outlet when full power is selected, since 240 volt power would be unavailable.

SUMMARY OF THE INVENTION

Accordingly, the present invention is directed to a full power switch assembly for a portable generator that is capable of instantly communicating the presence and operation of a full power switch to the user. The full power switch assembly includes a first outlet for supplying electrical power having a first voltage (e.g., 120 VAC), a second outlet for supplying electrical power having a second voltage (e.g., 240 VAC), and a switch including a selector. The selector is movable from a first position to a second position for causing the first outlet to be capable of supplying electrical power up to a maximum power level. Movement of the selector between the first position and the second position further causes indicia to be displayed for indicating whether the first outlet is capable of supplying electrical power up to the maximum power level. In exemplary embodiments of the invention, the selector includes a mechanical interlock for preventing a plug from being received by the second outlet when the selector is in the second position.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
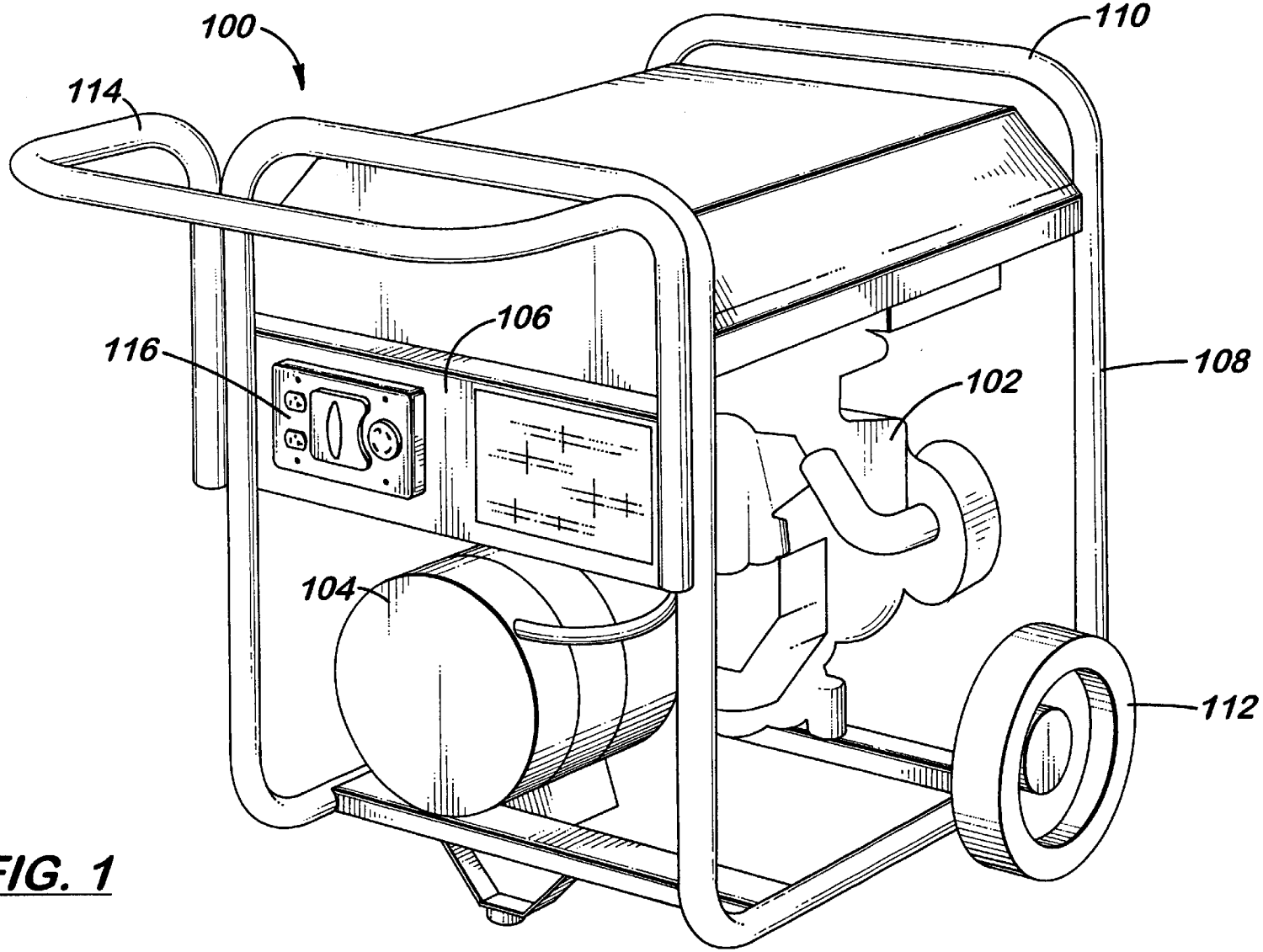
FIG. 1 is an isometric view illustrating a portable generator having a power selector switch assembly in accordance with an exemplary embodiment of the present invention.

Referring now to FIG. 1, a portable generator having a power selector switch assembly in accordance with an exemplary embodiment of the present invention is described. The portable generator 100 includes an engine 102, an alternator 104, an output/control panel 106 mounted within a frame 108. Engine 102 provides mechanical energy for turning the alternator 104. Preferably, engine 102 is comprised of an internal combustion engine, and may run on fuels such as gasoline, liquified propane (LP) gas, diesel fuel, natural gas or the like. In exemplary embodiments, engine 102 may be an OHV (Overhead-Valve) engine, may utilize CIS (Cast Iron Sleeve) cylinder technology to improve its performance and useful life. Alternator 104, often referred to in the art as a "genhead" is coupled to the drive shaft of the engine either directly or via a belt, chain or the like, and converts the mechanical energy generated by the engine 102 into electricity. Preferably, the output of alternator 104 is connected such that there are two 240 VAC power leads in addition to a neutral lead. This provides the user with the choice of using either 240 volts or 120 volts in any combination up to the limit of the generator 100. Output/control panel 106 supports electrical outlets (receptacles), circuit breakers or other circuit protection apparatus, controls (switches) for controlling the output of electrical power by the generator 100, and controls for controlling the engine 102 (e.g., an electric start switch, an idle control, an on/off switch), and the like. Frame 108 supports the engine 102, alternator 104 and output/control panel 106, as a portable, unitary unit that may be easily transported by the user. Frame 108 may also support a fuel tank 110 for providing a source of fuel for engine 102. In exemplary embodiments, fuel tank 110 is positioned above engine 102 so that fuel is supplied to the engine via a gravity feed. Frame 108 may further include wheels 112 and handle 114 for transport of the generator 100.

In accordance with the present invention, output/control panel 106 includes a full power switch assembly 116 for allowing a user to switch off the 240 volt output in order to get more 120 volt power from the generator thereby improving the generator's ability to power larger 120 volt loads and to sustain 120 volt surge loads. When full power is selected, the alternator output is reconnected so that the windings are coupled together to additively produce 120 volts while making 240 volt output unavailable. Preferably, the full power switch assembly 116 is capable of instantly communicating the presence and operation of a full power switch to the user. Further, in embodiments of the invention, the switch assembly 116 provides a mechanical interlock feature that requires the user to disengage a plug or plugs from any 240 volt outlets since these outlets become disabled by the switch action. In this manner, the user is forced to use the "full power" feature of the generator 100 correctly, thereby increasing the utility of the generator 100.

Referring now to FIGS. 2 through 9, exemplary full power switch assemblies in accordance with the present invention are described in greater detail. In the embodiments shown, the full power switch assembly 116 includes one or more outlets or receptacles 118 suitable for supplying electrical power having a first voltage. For instance, outlets 118 may be duplex 15 amp, 120 volt electrical outlets capable of supplying electrical power having a nominal voltage of 120 VAC. A second outlet or outlets 120 is positioned in the full power switch assembly 116 opposite first outlets 118 for supplying electrical power having a second voltage. In FIGS. 2 through 7, switch assemblies 116 having a single 30 amp, 240 volt electrical outlet capable of supplying electrical power having a nominal voltage of 240 VAC are shown. Alternately, in FIGS. 8 and 9, a switch assembly 116 having duplex 30 amp, 240 volt electrical outlets is shown. It is contemplated that, based on the present disclosure, those of ordinary skill in the art may now design full power switch assemblies 116 in accordance with the present invention that employ outlet configurations other than those specifically shown herein. Further, it will be appreciated that while generators providing 120/240 VAC outputs as commonly used in the United States are shown and described herein, full power switch assemblies in accordance with the present invention may be employed by generators providing outputs having other voltages such as, for example, voltages that are common in countries other than the United States (e.g., 100/200 VAC in Japan). Such full power switch assemblies and the generators in which they are employed would not depart from the scope and spirit of the present invention.

A full power switch 122 having a selector 124 is disposed between the outlets 118 and outlet(s) 120. The selector 124 is movable between a first or "normal" position, shown in FIGS. 2, 4 and 6, and a second or "full power" position, shown in FIGS. 3, 5 and 7. In exemplary embodiments, the selector 124 may be finished with a bright color, and may be relatively large in size compared to outlets 118 & 120.

Preferably, full power switch 122 permits normal 120/240 volt operation of the generator 100 when selector 124 is moved to the first or "normal" position. When selector 124 is moved to the second or "full power" position, the alternator output is reconnected so that the windings are coupled together to additively produce 120 volts while making 240 volt output unavailable. In this manner, outlets 118 may be capable of supplying 120 volt power electrical power up to a maximum power level thereby improving the generator's ability to power larger 120 volt loads and to sustain 120 volt surge loads.

Figure 2:
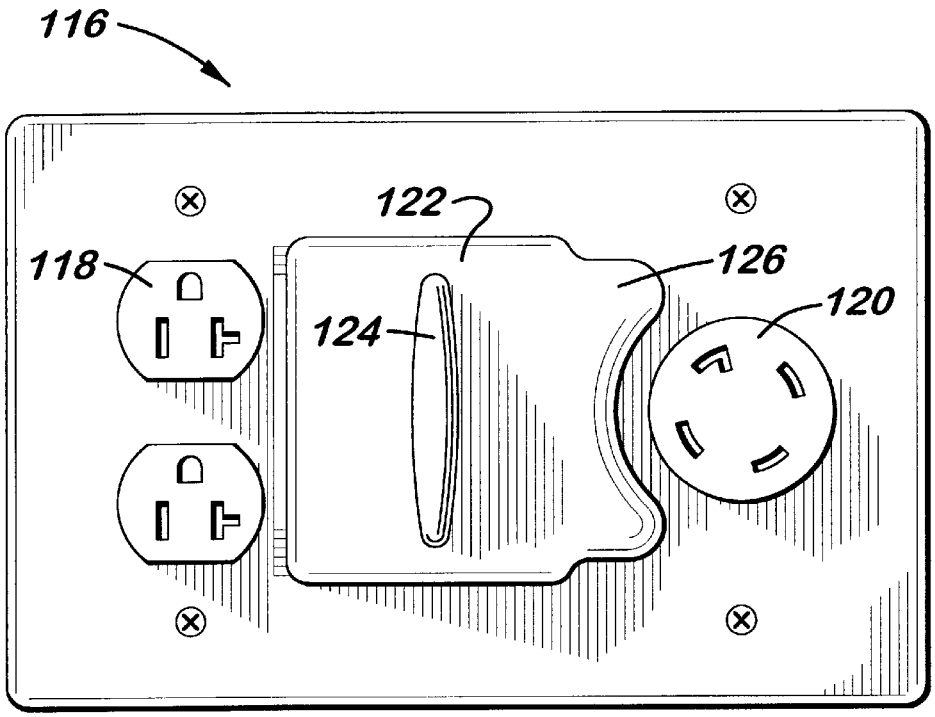
FIG. 2 is a side elevation view illustrating the power selector switch assembly shown in FIG. 1, wherein full power operation is deselected.

As shown in FIGS. 2 though 9, movement of the selector 124 between the first position, shown in FIGS. 2, 4, 6, and 8, and the second position, shown in FIGS. 3, 5, 7 and 9, further causes indicia to be displayed for indicating whether outlets 118 are capable of supplying electrical power up to the maximum power level. For example, in the embodiments of the invention shown, the indicia "MOTOR START" 128 are disposed on the face of the full power switch assembly 116 so that the indicia are substantially covered by selector 124 when the selector 124 is in the first or "normal" position. As selector 118 is moved to the second or "full power" position, indicia 128 are uncovered so that they are viewable by a user of the generator 100. It will be appreciated that the indicia 128 displayed by full power switch assembly 116 when selector 124 is moved to the second or "full power" position are not limited to the words "MOTOR START" shown in FIGS. 2 through 9, but instead may include any word, phrase, symbol, or the like suitable for providing an indication to the user as to whether outlets 118 are capable of supplying electrical power up to the maximum power level. Thus, embodiments of the present invention may utilize phrases such as "MAXIMUM POWER", "MAX POWER", "FULL POWER", an iconic symbol or symbols, or the like without departing from the scope and spirit of the present invention.

In exemplary embodiments of the invention, selector 124 includes a mechanical interlock 126 for preventing a plug from being received by outlet(s) 120 when selector 124 is in or near the second or "full power" position shown in FIGS. 3, 5, 7 and 9. In this manner, the mechanical interlock 126 requires the user to disengage and remove a plug previously inserted in outlet(s) 120 before full power is selected since outlet(s) 120 (240 VAC power) becomes at least partially disabled by the switch action. If "normal" 240 volt power is thereafter required, selector 124 again moved to the first position causing outlet(s) 120 to become available to receive a 240 volt plug.

Figure 3:
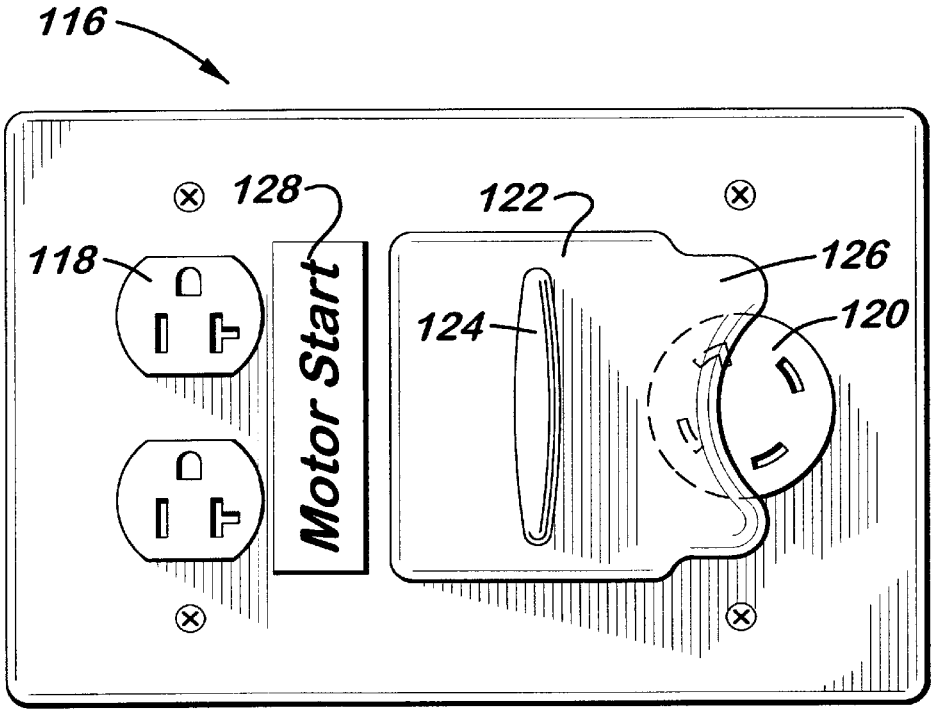
FIG. 3 is a side elevation view illustrating the power selector switch assembly shown in FIG. 2, wherein full power operation is selected.
Figure 4:
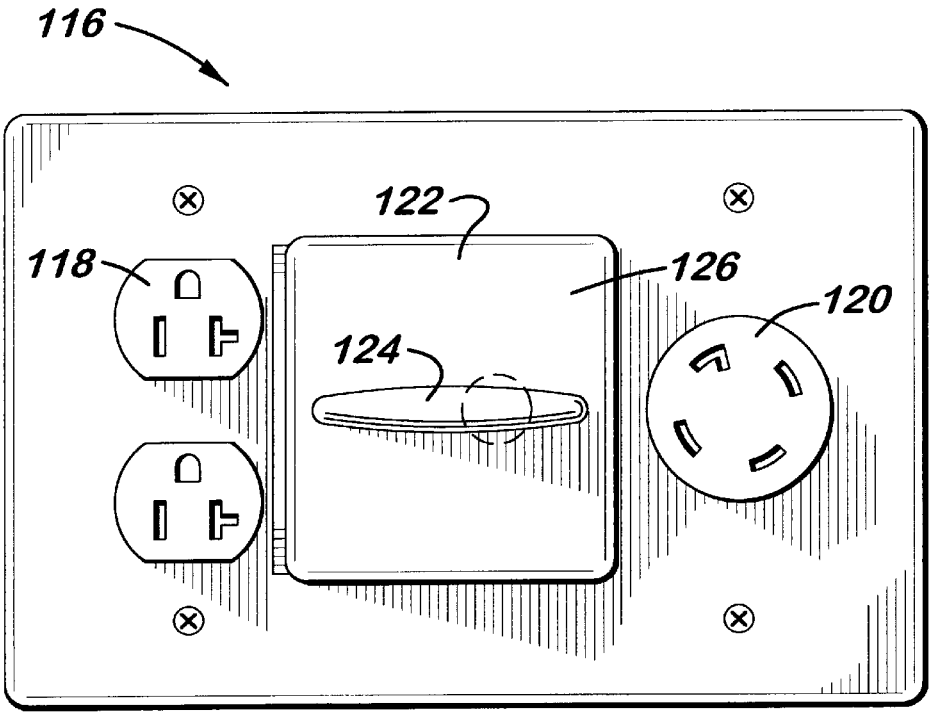
FIG. 4 is a side elevation view illustrating a power selector switch assembly employing a rotary switch in accordance with an alternate embodiment of the present invention, wherein full power operation is deselected.
Figure 5:
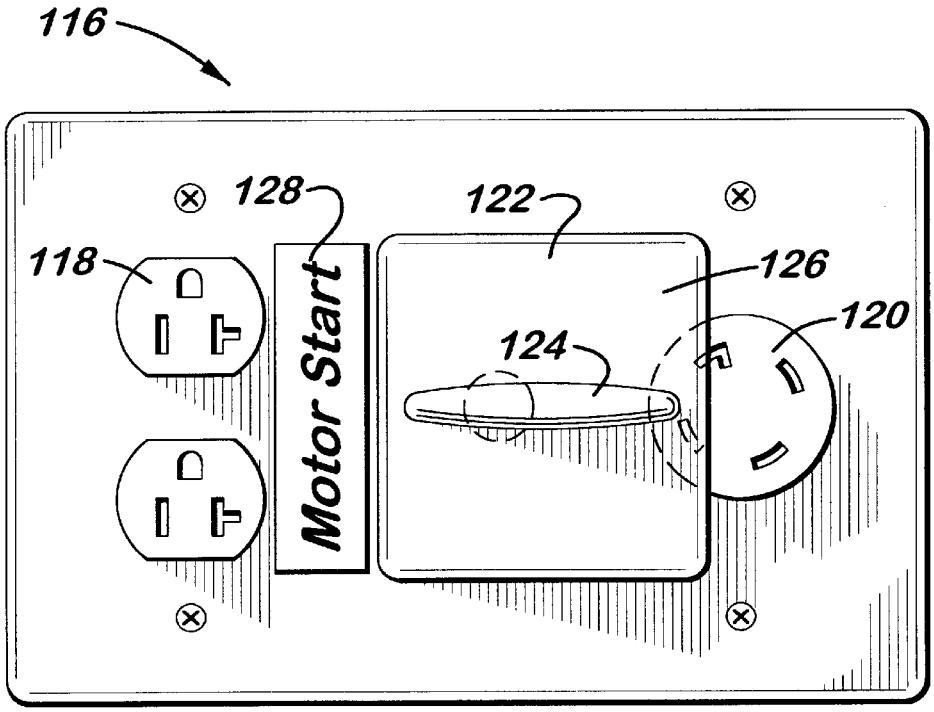
FIG. 5 is a side elevation view illustrating the power selector switch assembly shown in FIG. 4, wherein full power operation is selected.
Figure 6:
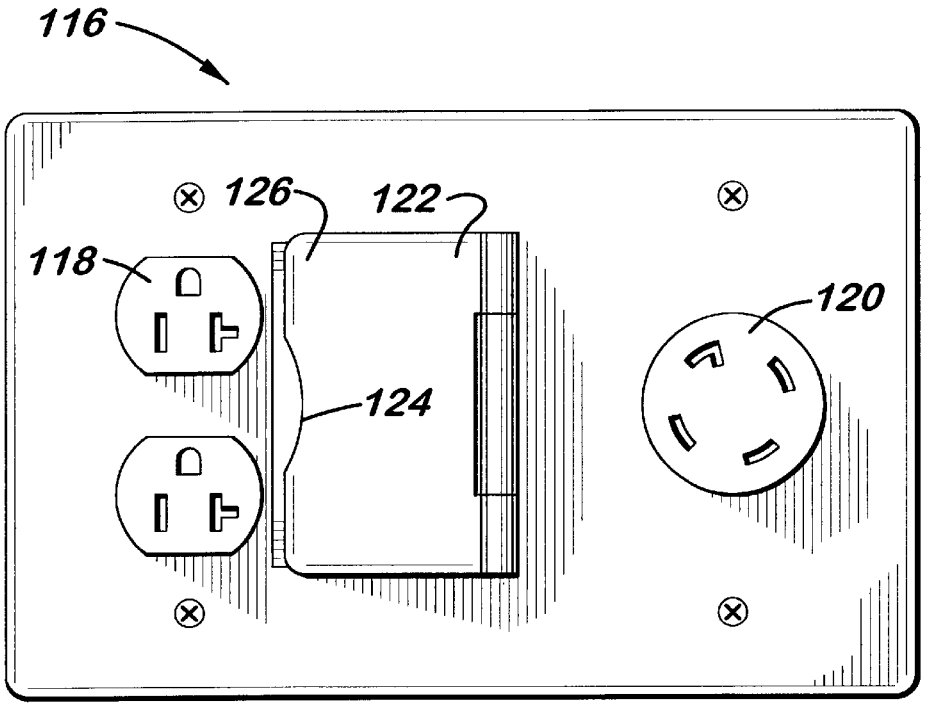
FIG. 6 is a side elevation view illustrating a power selector switch assembly employing a toggle switch in accordance with an alternate embodiment of the present invention, wherein full power operation is deselected.
Figure 7:
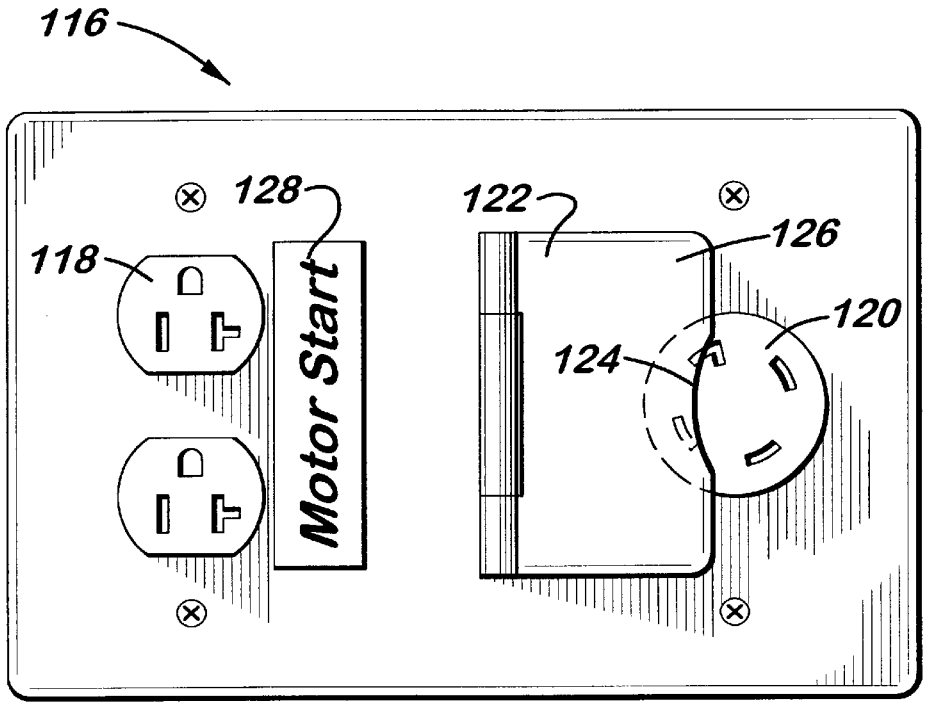
FIG. 7 is a side elevation view illustrating the power selector switch assembly shown in FIG. 6, wherein full power operation is selected.
Figure 8:
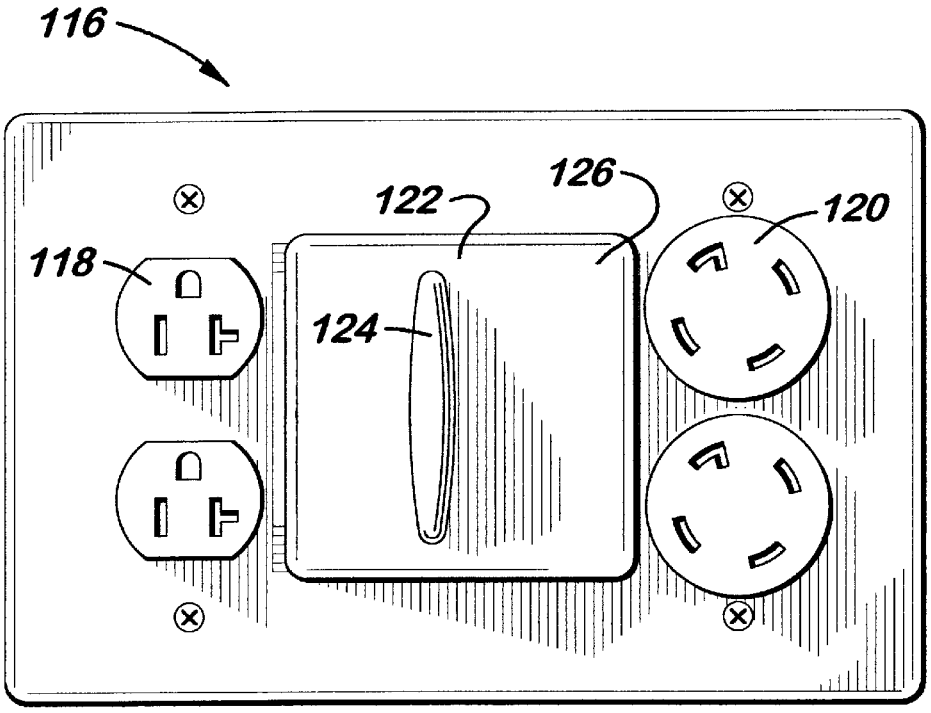
FIG. 8 is a side elevation view illustrating a power selector switch assembly employing a slide switch and duplex 240 VAC outlets in accordance with an alternate embodiment of the present invention, wherein full power operation is deselected.
Figure 9:
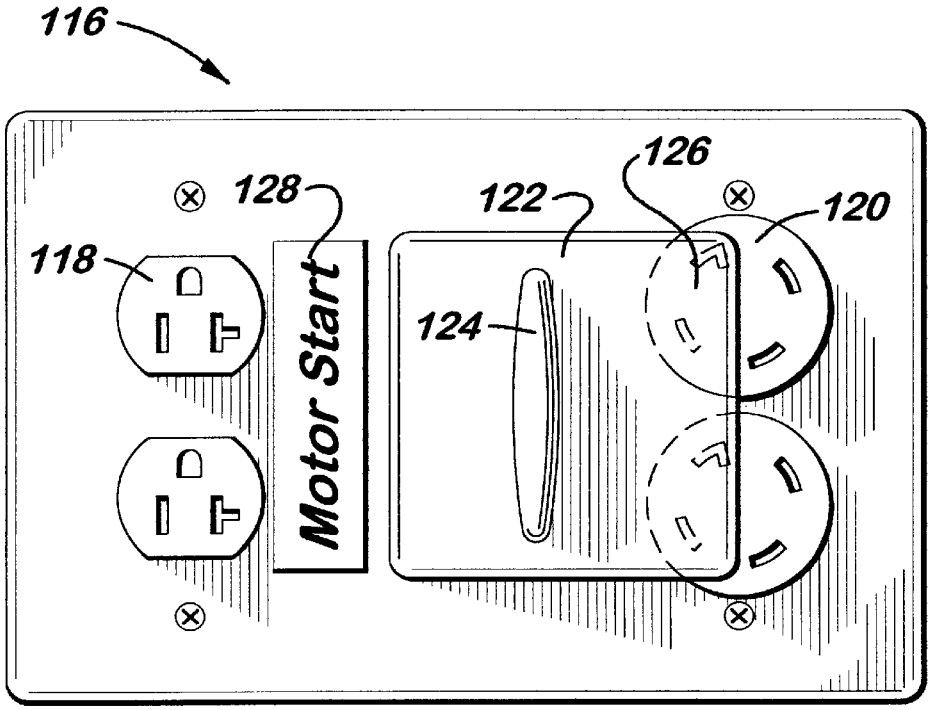
FIG. 9 is a side elevation view illustrating the power selector switch assembly shown in FIG. 8, wherein full power operation is selected.

As shown in FIGS. 2 through 9, movement of selector 124 between the first and second positions may be accomplished in variety of ways. For instance, FIGS. 2 and 3 illustrate a full power switch assembly 116 employing a rocker switch or slide switch, wherein selector 124 slides between the first position and the second position. In this embodiment, mechanical interlock 126 is slid over at least a portion of outlet 120 to prevent the outlet 120 from receiving a 240 volt plug. Alternately, as shown in FIGS. 4 and 5, power switch assembly 116 may employ a rotary switch so that the selector rotates between the first position and the second position and mechanical interlock 126 is likewise rotated over at least a portion of outlet 120. Similarly, power switch assembly 116 may utilize a toggle switch such that the selector 124 pivots between the first position and the second position partially covering outlet 120 to provide mechanical interlock 126. FIGS. 8 and 9 illustrate a full power switch assembly 116 employing a slide switch and duplex 120 VAC and 240 VAC outlets, wherein selector 124 slides between the first position and the second position. It will be appreciated that embodiments of the invention full power switch assembly 116 shown in FIGS. 8 and 9 may alternately employ the rotary or toggle switches of the switch assembly embodiments shown in FIGS. 4 through 7, thus providing a selector 124 having an interlock 126 that either rotates or pivots to at least partially cover outlets 120.

In embodiments of the invention, full power switch assembly 116 may be biased to the full power position. For example, selector 124 may be spring biased to the second position wherein mechanical interlock 126 is slid over at least a portion of outlet 120 to prevent the outlet 120 from receiving a 240 volt plug. In this manner, the generator 100 is forced to operate in the full power mode (120 VAC output only) unless the user purposefully switches it to the normal mode (both 120 and 240 VAC output).

It is believed that the full power switch assembly of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A full power switch assembly for a generator, comprising:

a first outlet for supplying electrical power having a first voltage; and a switch including a selector movable between a first position and a second position, the switch being suitable for causing the first outlet to be capable of supplying electrical power up to a maximum power level when the selector is moved to the second position, wherein movement of the selector between the first position and the second position further causes indicia to be displayed for indicating whether the first outlet is capable of supplying electrical power up to the maximum power level.

2. The full power switch assembly as claimed in claim 1, further comprising a second outlet for supplying electrical power having a second voltage, wherein the selector includes a mechanical interlock for preventing a plug from being received by the second outlet when the selector is in the second position.

3. The full power switch assembly as claimed in claim 1, wherein the switch comprises one of a rocker switch and a slide switch, and wherein the selector slides between the first position and the second position.

4. The full power switch assembly as claimed in claim 1, wherein the switch comprises a rotary switch, and wherein the selector rotates between the first position and the second position.

5. The full power switch assembly as claimed in claim 1, wherein the switch comprises a toggle switch, and wherein the selector pivots between the first position and the second position.

6. The full power switch assembly as claimed in claim 2, wherein the first voltage is approximately 120 VAC and the second voltage is approximately 240 VAC.

7. The full power switch assembly as claimed in claim 1, wherein the selector is biased to the second position.

8. A full power switch assembly for a generator, comprising:

a first outlet for supplying electrical power having a first voltage;

a second outlet for supplying electrical power having a second voltage;

a switch including a selector movable between a first position and a second position, the switch being suitable for causing the first outlet to be capable of supplying electrical power up to a maximum power level when the selector is moved to the second position; and a mechanical interlock coupled to the selector for preventing a plug from being received by the second outlet when the selector is in the second position.

9. The fill power switch assembly as claimed in claim 8, wherein movement of the selector between the first position and the second position causes indicia to be displayed for indicating whether the first outlet is capable of supplying electrical power up to the maximum power level.

10. The full power switch assembly as claimed in claim 8, wherein the switch comprises one of a rocker switch and a slide switch, and wherein the selector slides between the first position and the second position.

11. The full power switch assembly as claimed in claim 8, wherein the switch comprises a rotary switch, and wherein the selector rotates between the first position and the second position.

12. The full power switch assembly as claimed in claim 8, wherein the switch comprises a toggle switch, and wherein the selector pivots between the first position and the second position.

13. The full power switch assembly as claimed in claim 8, wherein the first voltage is approximately 120 VAC and the second voltage is approximately 240 VAC.

14. The fill power switch assembly as claimed in claim 8, wherein the selector is biased to the second position.

15. A generator, comprising:

an alternator for generating electrical power from mechanical power;

an engine for providing mechanical power to the alternator; and a first outlet for supplying the electrical power generated by the alternator at a first voltage;

a second outlet for supplying electrical power generated by the alternator at a second voltage; and a switch including a selector movable between a first position and a second position, the switch being suitable for switching off the electrical power supplied by the second outlet and causing the first outlet to be capable of supplying electrical power up to a maximum power level when the selector is moved to the second position, wherein movement of the selector between the first position and the second position exposes indicia for indicating whether the first outlet is capable of supplying electrical power up to the maximum power level.

16. The generator as claimed in claim 15, wherein the selector comprises a mechanical interlock for preventing a plug from being received by the second outlet when the selector is in the second position.

17. The generator as claimed in claim 15, wherein the switch comprises one of a rocker switch and a slide switch, and wherein the selector slides between the first position and the second position.

18. The generator as claimed in claim 15, wherein the switch comprises a rotary switch, and wherein the selector rotates between the first position and the second position.

19. The generator as claimed in claim 15, wherein the switch comprises a toggle switch, and wherein the selector pivots between the first position and the second position.

20. The generator as claimed in claim 15, wherein the selector is biased to the second position.

21. A generator, comprising:

an alternator capable of generating electrical power from mechanical power;

an engine for providing mechanical power to the alternator; and a first outlet for supplying the electrical power generated by the alternator at a first voltage;

a second outlet for supplying electrical power generated by the alternator at a second voltage; and a switch including a selector movable between a first position and a second position, the switch being suitable for causing the first outlet to be capable of supplying electrical power up to a first maximum power level when the selector is moved to the first position, and to be capable of supplying electrical power up to a second maximum power level when the selector is moved to the second position by switching off the electrical power supplied by the second outlet;

wherein movement of the selector between the first position and the second position exposes indicia for indicating whether the first outlet is capable of supplying electrical power up to the maximum power level and prevents a plug from being received by the second outlet when the selector is in the second position.

22. The generator as claimed in claim 21, wherein the switch comprises one of a rocker switch and a slide switch, and wherein the selector slides between the first position and the second position.

23. The generator as claimed in claim 21, wherein the switch comprises a rotary switch, and wherein the selector rotates between the first position and the second position.

24. The generator as claimed in claim 21, wherein the switch comprises a toggle switch, and wherein the selector pivots between the first position and the second position.

25. The generator as claimed in claim 21, wherein the selector is biased to the second position.

26. A full power switch assembly for a generator, comprising:

means for providing electrical power having a first voltage; and means for selecting whether electrical power up to a maximum power level to be supplied to the means for providing electrical power having a first voltage;

wherein the selecting means causes indicia to be displayed for indicating whether the means for providing electrical power having a first voltage is capable of supplying electrical power up to the maximum power level.

27. The full power switch assembly as claimed in claim 26, further comprising means for providing electrical power having a second voltage; and means for preventing a plug from being received by the means for providing electrical power having a second voltage.

28. The full power switch assembly as claimed in claim 26, further comprising means for biasing the selecting means.

29. A full power switch assembly for a generator, comprising:

means for providing electrical power having a first voltage;

means for providing electrical power having a second voltage;

means for selecting whether electrical power up to a maximum power level to be supplied to the means for providing electrical power having a first voltage;

means for preventing a plug from being received by the means for providing electrical power having a second voltage.

30. The full power switch assembly as claimed in claim 29, wherein the selecting means further causes indicia to be displayed for indicating whether the means for providing electrical power having a first voltage is capable of supplying electrical power up to the maximum power level.

31. The full power switch assembly as claimed in claim 29, further comprising means for biasing the selecting means.

* * * * *